US006458021B1

(12) United States Patent
Takeyama et al.

(10) Patent No.: US 6,458,021 B1
(45) Date of Patent: Oct. 1, 2002

(54) POLISHING APPARATUS WITH A BALANCE ADJUSTING UNIT

(75) Inventors: Katsumi Takeyama; Kenichi Kano, both of Miyagi (JP)

(73) Assignee: Sony Corporation (JP)

( * ) Notice: Subject to any disclaimer, the term of this patent is extended or adjusted under 35 U.S.C. 154(b) by 75 days.

(21) Appl. No.: 09/653,197

(22) Filed: Aug. 31, 2000

(30) Foreign Application Priority Data

Sep. 3, 1999 (JP) ..... 11-249892

(51) Int. Cl.[7] ..... B24B 21/00

(52) U.S. Cl. ..... 451/302; 451/303; 451/311; 451/489

(58) Field of Search ..... 451/41, 59, 297, 451/302, 303, 305, 306, 307, 311, 489, 491

(56) References Cited

U.S. PATENT DOCUMENTS 5,433,042 A * 7/1995 Billieres et al. ..... 451/307
5,791,969 A * 8/1998 Lund ..... 451/289
5,820,446 A * 10/1998 Lu ..... 451/302
5,885,143 A * 3/1999 Ichikawa et al. ..... 451/168
5,899,794 A * 5/1999 Shige et al. ..... 451/304

* cited by examiner

*Primary Examiner*—Timothy V. Eley
(74) *Attorney, Agent, or Firm*—Ronald P. Kananen, Esq.; Rader, Fishman, & Grauer, PLLC.

(57) ABSTRACT

A polishing apparatus includes a lapping tape for polishing a surface of a magnetic disc, a tape supply unit for supplying the lapping tape, a varnisher roller for pressing the lapping tape onto the surface of the magnetic disc, and a pressing unit for pressing the lapping tape to the surface of the magnetic disc by way of the varnisher roller. The pressing unit is constituted by a swing lever having the varnisher roller at one end portion, and a balance adjusting unit. The balance adjusting unit sets the pressing force to zero by establishing the balance of the swing lever, and then breaks the balance so as to press the lapping tape to the surface of the magnetic disc by way of the varnisher roller with a desired pressing force.

15 Claims, 1 Drawing Sheet

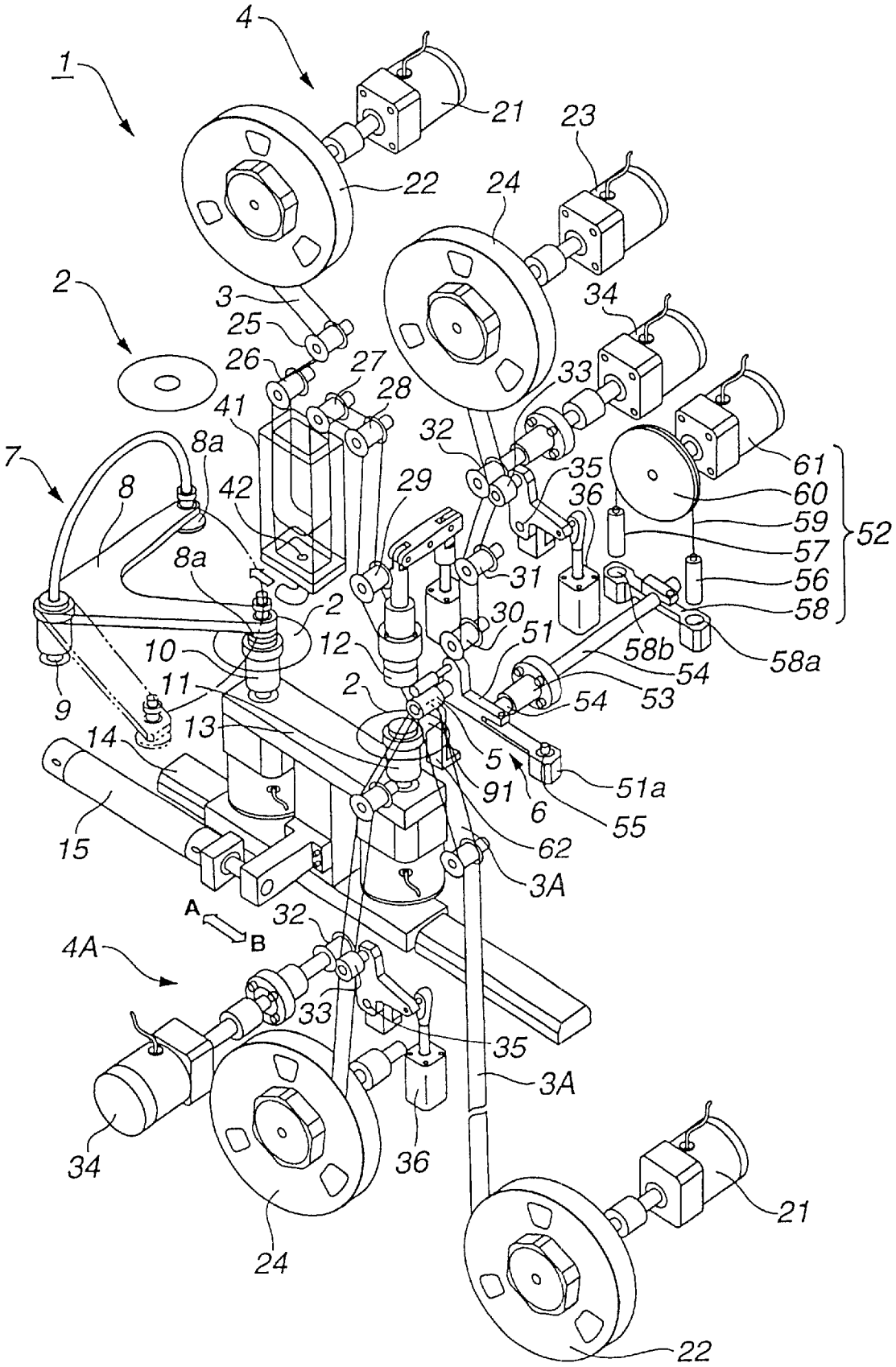
1
2
3
4
4A
5
6
7
8
8a
9
10
11
12
13
14
15
21
22
23
24
25
26
27
28
29
30
31
32
33
34
35
36
41
42
51
51a
52
53
54
55
56
57
58
58a
58b
59
60
61
62
91
3A
A
B

POLISHING APPARATUS WITH A BALANCE ADJUSTING UNIT

BACKGROUND OF THE INVENTION

1. Field of the Invention:

This invention relates to polishing apparatus for polishing surfaces of material to be polished with abrasive, and more particularly to polishing apparatus which is suitably used in a so-called varnishing system which shaves off protrusions on surfaces of a magnetic disc without injuring the surfaces or the like.

2. Description of the Related Art

As the polishing apparatus which is used for the varnishing system, a polishing apparatus which includes a lapping tape for polishing a surface of a magnetic disc, a tape supply unit for supplying the lapping tape, a rubber roller for bringing the lapping tape supplied by the tape supply unit into contact with the surface of the magnetic disc, and a pressing unit for pressing the lapping tape to the surface of the magnetic disc with a given pressure by way of a rubber roller is known.

Meanwhile, since the polishing apparatus uses the pneumatic cylinder as the pressing unit, the apparatus has the following drawbacks.

(1) Since the pneumatic pressure is liable to fluctuate, it is difficult to hold the pressing force at a desired level.

(2) It is difficult to adjust the pressing force of the pneumatic cylinder. Particularly, it is difficult to add the minute pressing force in the order of several grams to the lapping tape with the pneumatic cylinder.

(3) The pneumatic cylinder is not adequate to bring the lapping tape into gradual and soft contact with the magnetic disc , and to gradually and softly move the lapping tape away from the magnetic disc.

SUMMARY OF THE INVENTION

It is therefore an object of the present invention to provide a polishing apparatus capable of producing a desired pressing force.

According to the present invention, a polishing apparatus comprises:

- a abrasive material supply unit (4, 7) for supplying an abrasive material;
- a first abrasive material guide member (5) for pressing the abrasive material supplied from the abrasive material supply unit, to a first surface of the material to be polished; and
- a pressing unit (6) for pressing the abrasive material to the first surface of the material to be polished with a predetermined pressing force by way of the abrasive material guide member. The pressing unit comprises, a swing lever (51) provided with the abrasive material guide member (5), and a balance adjusting unit (52) which presses the abrasive material to the material to be polished by way of the abrasive material guide member with a desired load determined by adjusting a load applied to the swing lever.

BRIEF DESCRIPTION OF THE DRAWING

A single FIGURE is a perspective view showing a polishing apparatus according to one embodiment of the present invention.

DESCRIPTION OF THE PREFERRED EMBODIMENTS

A single FIGURE schematically shows in perspective a polishing apparatus 1 according to one embodiment of the present invention. The polishing apparatus 1 includes an abrasive material 3 which polishes a material 2 to be polished, an abrasive material supply unit 4 which supplies the abrasive material 3, a first abrasive material guide member 5 which brings the abrasive material 3 supplied by the abrasive material supply unit 4 into contact with a first surface of the material 2 to be polished, and a pressing unit 6 which presses the abrasive material 3 to the first surface of the material 2 to be polished at a given pressure by way of the first abrasive material guide member 5.

The material 2 to be polished is a magnetic disc and is provided with magnetic layers on upper and lower surfaces of a circular plate made of plastic. A metal hub for chucking is provided at the central portion of the plastic circular plate. (Some magnetic discs have no metal hub.)

The magnetic disc as the material 2 to be polished (the material to be polished is simply called magnetic disc 2 hereinafter) is supplied by a rotary-type disc supply device 7.

The disc supply device 7 includes a V-shaped rotary arm 8 which is provided with vacuum-type disc suction heads 8*a* at both ends thereof.

In the disc supply device 7, after sucking a magnetic disc 2 with one of the disc suction heads 8*a*, the V-shaped rotary arm 8 is rotated about a vertical shaft 9 as the center of rotation so as to transport the magnetic disc 2 to a position just above a first spindle 10 or a second spindle 11. Thereafter, the suction by vacuum is released to place the magnetic disc 2 on either the first spindle 10 or the second spindle 11.

The position of the first spindle 10 shown in the FIGURE is a transfer position for receiving a disc 2. The position of the second spindle 11 shown in the FIGURE is a polishing position for polishing a disc 2. At the polishing position, a chucking member 12 is lowered until the magnetic disc 2 is chucked onto the spindle. Thereafter, the chucked magnetic disc 2 is rotated by the spindle to polish the magnetic disc 2.

The first and second spindles 10 and 11 are disposed, respectively, at first and second end portions of a slide table 13. The slide table 13 extends from the first end portion to the second end portion along a slide direction (shown by an arrow A-B) along which the slide table 13 is slidable.

The slide table 13 is driven by a rail 14 and a pneumatic cylinder (or air cylinder) 15. The first and second spindles 10, 11 are movable between the transfer position and the polishing position.

A lapping tape is used as the abrasive material 3. (Hereinafter, the abrasive material is simply called "lapping tape 3"). The lapping tape 3 has a base film coated with abrasive particles of alumina, chromium oxide, silicon carbide or the like, having the average particle size of 0.1~10 $\mu$m.

The abrasive material supply unit 4 includes a tape supply reel 22 provided with a torque motor 21, a tape winding (or take-up) reel 24 provided with a torque motor 23, first to seventh tape guide rollers 25~31 so arranged between the tape supply reel 22 and the tape winding reel 24 as to constitute a tape path system of the lapping tape 3, a pair of a tape drive roller 32 and a nip roller 33 disposed between the seventh tape guide roller 31 and the tape winding reel 24, a motor 34 for rotating the drive roller 32, and a pneumatic cylinder (or air cylinder) 36 which rotates the nip roller 33 about a shaft 35 in the direction to bring the nip roller 33 into contact with the tape drive roller 32 or in the direction to move the nip roller 33 away from the tape drive roller 32.

The lapping tape 3 is clamped between the tape drive roller 32 and the nip roller 33 rotated about the shaft 35 by the pneumatic cylinder 36 toward the tape drive roller 32. Then, the tape drive roller 32 is rotated by the motor 34 so as to perform the supply of the lapping tape 3.

Between the second tape guide roller 26 and the third tape guide roller 27, a vacuum chamber 41 is provided for maintaining the tape tension of the lapping tape 3 at a constant value. The lapping tape 3 is introduced into the vacuum chamber 41, between the second and third tape guide rollers 26 and 27.

The lapping tape 3 introduced into the inside of the vacuum chamber 41 is sucked by a negative pressure generated by a vacuum pump (not shown in the drawing) and introduced through a vacuum suction hole 42 formed in the bottom of the vacuum chamber 41 so that the tape tension of the lapping tape 3 can be maintained at an approximately constant value.

Above the magnetic disc 2 at the polishing position, there is provided the first abrasive material guide member 5 for bringing the lapping tape 3 into contact with the upper surface of the magnetic disc 2.

As the first abrasive material guide member 5, a rubber roller of hard urethane rubber having a hardness of about 65 is used, for example. (Hereinafter, the first abrasive material guide member is called "the first varnisher roller 5".)

The first varnisher roller 5 is extended in the radial direction of the magnetic disc 2, and arranged to press the lapping tape 3 onto the upper surface of the magnetic disc 2 with a desired load (pressure) by means of the pressing unit 6.

The pressing unit 6 includes a swing lever (or bar)51 which is provided with the first varnisher roller 5, and a balance adjusting unit 52 which presses the lapping tape 3 to the magnetic disc 2 at a desired load by way of the first varnisher roller 5 by adjusting the load applied to the swing arm 51.

The first swing lever 51 is mounted on a first end portion of a rotary shaft 54 which is rotatably supported by a bearing 53.

The balance adjusting unit 52 includes first, second and third balance weights 55, 56 and 57. The first balance weight 55 establishes the balance (equilibrium) of the swing arm 51 by applying the load to the swing lever 51. The second balance weight 56 applies a load to the swing lever 51 in the direction to move the first varnisher roller 5 and the lapping tape 3 away from the first surface (upper surface) of the magnetic disc 2. The third balance weight 57 applies a load to the swing lever 51 in the direction to bring the first varnisher roller 5 and the lapping tape 3 into contact with the first surface (upper surface) of the magnetic disc 2.

The first balance weight 55 is placed in a first balance weight receiving portion 51a provided at a first lever end portion of the swing lever 51 opposite to the first varnisher roller 5 so as to establish the balance of the swing arm 51. The first varnisher roller 5 is located at a second lever end portion, the first balance weight 55 is at the first lever end portion, and the first shaft end portion of the shaft 54 (serving as a center fulcrum) is located between the first and second lever end portions.

A second balance weight receiving portion 58*a* for receiving the second balance weight 56 is provided at a first end portion of a balance weight receiving lever (or bar) 58 which is mounted on a second shaft end portion of the rotary shaft 54. The balance weight receiving lever 58 extends approximately in parallel to the swing lever 51. The second balance weight 56, when placed in the weight receiving portion 58*a*, acts to rotate the shaft 54 and to move the first Varnisher roller 5 and the lapping tape 3 away from the disc 2 to a standby position.

A third balance weight receiving portion 58*b* is provided at a second lever end portion of the balance weight receiving lever 58. The second shaft end of the shaft 54 serving as the fulcrum is located between the second and third balance weight receiving portions 58*a* and 58*b*. The third balance weight 57, when placed in the receiving portion 58*b*, acts to rotate the swing lever 51 through the shaft 54 in the direction to move the first varnisher roller 5 and the lapping tape 3 toward the magnetic disc 2 until the lapping tape 3 comes into contact with the first surface (upper surface) of the magnetic disc 2.

The second balance weight 56 and the third balance weight 57 are connected by a rope 59 running through a pulley 60.

The pulley 60 is rotatably driven by a motor 61. When the pulley 60 is rotated in one direction (clockwise direction), the second balance weight 56 is placed on the second balance weight receiving portion 58*a* and the third balance weight 57 is lifted up from the third balance weight receiving portion 58*b*. When the pulley 60 is rotated in the other direction (counterclockwise direction), the third balance weight 57 is placed on the third balance weight receiving portion 58*b* and the second balance weight 56 is lifted up from the second balance weight receiving portion 58*a*.

Each of the first, second and third balance weights 55, 56 and 57 is adjustable so that the weight can be adjusted in the order of 1 gram.

The weight of the first balance weight 55 is set to a value to cancel the weight of the first varnisher roller 5, and to establish a balance of the swing lever 51.

The weight of the second balance weight 56 is set to a weight value required to rotate the swing lever 51 balanced by the first balance weight 55, in the direction to move the lapping tape 3 away from the first surface (upper surface) of the magnetic disc 2 through a predetermined distance to the standby position.

The third balance weight 57 is set to a weight to produce a desired load with which the lapping tape 3 is pressed to the first surface (upper surface) of the magnetic disc 2. If, for example, the desired load is 10 grams, then the weight of the third balance weight 57 is set equal to grams.

At a lower position confronting the first varnisher roller 5 across the magnetic disc 2, there is provided a second abrasive material guide member 91 for bringing a lapping tape 3A for polishing the lower surface of the magnetic disc 2 into contact with the lower surface of the magnetic disc 2.

As the second abrasive material guide member 91, a rubber roller is used as in the case of the first varnisher roller 5. (Hereinafter, the second abrasive material guide member is called "second varnisher roller".)

The second varnisher roller 91 is fixedly secured to a roller support member 62. The second varnisher roller 91 is disposed under the magnetic disc 2 so as to form a gap of approximately 0.1~1 mm between the second varnisher roller 91 and the lower surface of the magnetic disc 2 to prevent the lapping tape from contacting with the lower surface of the magnetic disc 2 on the spindle 10 or 11 when positioned at the polishing position by the slide table 13. The roller support member 62 is provided with a load cell (not shown in the drawing) which detects the load (pressing force) of the pressing unit 6 applied by way of the second varnisher roller 91.

The supply of the lower side lapping tape 3A is achieved by a lower side abrasive material supply unit 4A.

Since the lower side abrasive material supply unit 4A is substantially identical in construction to the upper side abrasive material supply unit 4, the same constituent parts are given the same reference numerals and their explanation is omitted.

Subsequently, the manner of operation of the polishing device 1 of the present invention is explained. The first balance weight 55 is placed on the first balance weight receiving portion 51a of the swing lever 51 to establish the balance of the swing arm 51. Then, the pulley 60 is rotated in the clockwise direction to place the second balance weight 56 on the second balance weight receiving portion 58*a*. When the second balance weight 56 is placed, the balance of the swing arm 51 is broken and the first varnisher roller 5 and the lapping tape 3 are retracted to the standby position where they are not obstructive to the movement of the magnetic disc 2 to the polishing position. The magnetic disc 2 supplied to the disc supply device 7 is sucked by one disc suction head 8*a* of the disc supply device 7, and then placed on the spindle waiting at the transfer position. The magnetic disc 2 the spindle is transported from the transfer position to the polishing position by the slide table 13.

When the second balance weight 56 is lifted from the second balance weight receiving portion 58*a* by rotating the pulley 60 in the counterclockwise direction, the swing lever 51 again attains the balance. By rotating the pulley 60 further in the counterclockwise direction, the third balance weight 57 is placed on the third balance weight receiving portion 58*b* so that the first varnisher roller 5 and the lapping tape 3 are pressed to the first surface (upper surface) of the magnetic disc 2 with the load of the third balance weight 57, that is, with the load of 10 grams, and the lower surface of the magnetic disc 2 is also pressed to the lower side lapping tape 3A.

Subsequently, when the magnetic disc 2 is transported to the polishing position and is set in the chucked condition, the spindle is rotated at a predetermined rotational speed (300~1200 rpm).

Accordingly, the upper side lapping tape 3 and lower side lapping tape 3A are pressed to the upper and lower surfaces of the magnetic disc 2 with approximately the same loads (about 10 grams) and polish these upper and lower surfaces. Upon completion of the polishing, the pulley 60 is rotated in the clockwise direction to lift the third balance weight 57 from the third balance weight receiving portion 58*b* until the swing arm 51 again attains the balanced condition. When the pulley 60 is further rotated, the second balance weight 56 is placed on the second balance weight receiving portion 58*a*. Accordingly, the lapping tape 3 is moved to the standby position spaced from the first surface (upper surface) of the magnetic disc 2.

Then, after completion of polishing, the polished magnetic disc 2 is returned to the transfer position, and then sucked by one disc suction head 8*a* of the disc supply device 7 for transportation to a finished product stocker which is omitted from the drawing.

Although the weights of the second and third balance weights 56 and 57 are set to 10 grams in the illustrated example, the weights are adequately determined depending on the kind, the thickness or the like of the magnetic layer of the magnetic disc 2. Further, although the illustrated example employs a lapping tape as the abrasive material, the abrasive material is not limited to the lapping tape. Further, the material to be polished is not limited to the magnetic disc.

The polishing apparatus according to the present invention has following effects.

(1) The polishing apparatus is capable of polishing the material to be polished with a desired pressure by the use of a simple lever structure.

(2) The polishing apparatus can establish the balance of the swing lever with the first balance weight, move the abrasive material away from the first surface of the material to be polished by means of the second balance weight, and press the abrasive material to the first surface of the material to be polished by means of the third balance weight with a given load.

(3) The polishing apparatus can easily adjust the load by using the first, second and third balance weights are adjustable.

(4) The polishing apparatus can apply either one of the loads of the second and third balance weights to the swing lever while preventing the load of the other from being applied to the swing lever by a simple pulley structure.

(5) The polishing apparatus can polish the first and second surfaces of the material to be polished simultaneously.

(6) The polishing apparatus employs the first and second abrasive material guide members arranged to clamp the material to be polished thus realizing the effective polishing of the opposing surfaces.

(7) The polishing apparatus can accurately detect the pressing force (load) of the pressing unit by the load cell provided in the second abrasive material guide member.

(8) The polishing apparatus uses the rubber roller as the abrasive material guide member and hence, the supply and guide of the abrasive material can be carried out smoothly.

(9) The polishing apparatus uses the lapping tape as the abrasive material and hence, the continuous supply of the abrasive material can be carried out simply and easily using reels or the like.

(10) The polishing apparatus can maintain the tape tension of the lapping tape constantly at a low value by utilizing the negative pressure inside the vacuum chamber.

What is claimed is:

1. A polishing apparatus comprising:

an abrasive material supply unit for supplying an abrasive material;

a first abrasive material guide member which brings the abrasive material supplied by the abrasive material supply unit to a first surface of the material to be polished; and a pressing unit which presses the abrasive material to the first surface of the material to be polished with a predetermined pressing force by way of the abrasive material guide member, the pressing unit comprising, a swing lever provided with the abrasive material guide member and operative to pivot, and a balance adjusting unit which presses the abrasive material to the material to be polished by way of pivoting the swing lever so that the abrasive material guide member applies a desired load determined by adjusting a load applied to the swing lever.

2. A polishing apparatus according to claim 1, wherein the polishing apparatus further comprises a second abrasive material guide member for pressing the abrasive material to a second surface of the material to be polished, the second surface being opposite to the first surface of the material to be polished.

3. A polishing apparatus according to claim 2, wherein the second abrasive material guide member is disposed at such a position that the second abrasive material guide member confronts the first abrasive material guide member across the material to be polished.

4. A polishing apparatus according to claim 2, wherein the second abrasive material guide member is provided with a load cell for sensing the pressing force of the pressing unit.

5. A polishing apparatus according to claim 1, wherein the abrasive material guide member is a rubber roller.

6. A polishing apparatus according to claim 1, wherein the abrasive material is a lapping tape.

7. A polishing apparatus comprising:

an abrasive material supply unit for supplying an abrasive material;

a first abrasive material guide member which brings the abrasive material supplied by the abrasive material supply unit to a first surface of the material to be polished; and a pressing unit which presses the abrasive material to the first surface of the material to be polished with a predetermined pressing force by way of the abrasive material guide member, the pressing unit comprising, a swing lever provided with the abrasive material guide member and operative to pivot, and a balance adjusting unit which presses the abrasive material to the material to be polished by way of pivoting the swing lever so that the abrasive material guide member applies a desired load determined by adjusting a load applied to the swing lever, wherein the balance adjusting unit comprises:

a first balance weight which attains the balance of the swing lever by applying a load to the swing lever;

a second balance weight which applies a load to the swing lever to rotate the swing lever from a balanced state in a direction to move the abrasive material away from the first surface of the material to be polished; and a third balance weight which applies a load to the swing lever from the balanced state in a direction to press the abrasive material to the first surface of the material to be polished.

8. A polishing apparatus according to claim 7, wherein an amount of weight of each respective one of the first, second and third balance weights is changeable.

9. A polishing apparatus according to claim 8, wherein the polishing apparatus further comprises a pulley for moving the second and third balance weights upwardly and downwardly.

10. A polishing apparatus, comprising:

an abrasive material supply unit for supplying an abrasive material;

a first abrasive material guide member which brings the abrasive material supplied by the abrasive material supply unit to a first surface of the material to be polished; and a pressing unit which presses the abrasive material to the first surface of the material to be polished with a predetermined pressing force by way of the abrasive material guide member, the pressing unit comprising, a swing lever provided with the abrasive material guide member and operative to pivot, and a balance adjusting unit which presses the abrasive material to the material to be polished by way of pivoting the swing lever so that the abrasive material guide member applies a desired load determined by adjusting a load applied to the swing lever, wherein the abrasive material is a lapping tape and the polishing apparatus further comprises a vacuum chamber for holding the tension of the lapping tape supplied from the abrasive material supply unit at an approximately constant value.

11. A polishing apparatus comprising:

a disc support unit for supporting a disc at a polishing position; and a pressing mechanism including a first tape guide member for pressing a lapping tape to an upper surface of a disc, and a swing member having a pressing arm for applying a load to the first tape guide member to press the lapping tape onto the upper surface of the disc, a balance arm for adjusting the load applied to the first tape guide member and a rotary shaft interconnecting the pressing arm and the balance arm, wherein when the balance arm pivots, the rotary shaft pivots about its axis of rotation causing the pressing arm to pivot in a same angular direction as the balance arm.

12. A polishing apparatus according to claim 11, wherein the rotary shafts extends longitudinally along the axis of rotation and the pressing and balance arms extend perpendicularly to the axis of rotation.

13. A polishing apparatus, comprising:

a disc support unit for supporting a disc at a polishing position; and a pressing mechanism including a first tape guide member for pressing a lapping tape to an upper surface of a disc, and a swing member having a pressing arm for applying a load to the first tape guide member to press the lapping tape onto the upper surface of the disc, a balance arm for adjusting the load applied to the first tape guide member, wherein the swing member comprises the balance arm which is a first balance arm having a first weight receiving portion for receiving a first balance weight to rotate the pressing arm in a releasing direction, and a third balance arm having a third receiving portion for receiving a third balance weight to rotate the swing member in a pressing direction to increase the load.

14. A polishing apparatus according to claim 13, wherein the swing member further comprises a second balance arm having a second receiving portion for receiving a second balance weight to rotate the pressing arm in the releasing direction.

15. A polishing apparatus according to claim 14 wherein the swing member further comprises a rotating shaft defining a swing axis of the swing member and connecting the second and third balance arms with the first balance arm.

* * * * *

UNITED STATES PATENT AND TRADEMARK OFFICE

CERTIFICATE OF CORRECTION

PATENT NO. : 6,458,021 B1 
DATED : October 1, 2002
INVENTOR(S) : Katsumi Takeyama et al.

It is certified that error appears in the above-identified patent and that said Letters Patent is hereby corrected as shown below:

Column 8,
Line 30, replace "extends" with -- extend --.

Signed and Sealed this

Fifteenth Day of April, 2003

JAMES E. ROGAN
*Director of the United States Patent and Trademark Office*